US011255196B2

(12) United States Patent
Freno et al.

(10) Patent No.: US 11,255,196 B2
(45) Date of Patent: Feb. 22, 2022

(54) COOLING SYSTEM FOR ACTIVELY COOLING A TURBINE BLADE

(71) Applicants: MTU Aero Engines AG, Munich (DE); MAN Energy Solutions SE, Augsburg (DE)

(72) Inventors: Dieter Freno, Munich (DE); Thorsten Pöhler, Dinslaken (DE); Martin Pernleitner, Dachau (DE); Paul Storm, Kirchdorf a. d. Amper (DE); Electra Stavropoulou, Munich (DE); Dirk Frank, Voerde (DE)

(73) Assignees: MTU AERO ENGINES, Munich (DE); MAN Energy Solutions SE, Augsburg (DE)

( * ) Notice: Subject to any disclaimer, the term of this patent is extended or adjusted under 35 U.S.C. 154(b) by 46 days.

(21) Appl. No.: 16/537,278

(22) Filed: Aug. 9, 2019

(65) Prior Publication Data

US 2020/0049015 A1 Feb. 13, 2020

(30) Foreign Application Priority Data

Aug. 13, 2018 (DE) ..... 102018119572.9

(51) Int. Cl.
*F01D 5/18* (2006.01)

(52) U.S. Cl.
CPC ..... *F01D 5/186* (2013.01); *F05D 2240/304* (2013.01); *F05D 2250/185* (2013.01); *F05D 2260/202* (2013.01)

(58) Field of Classification Search
CPC ..... F01D 5/186; F05D 2240/304; F05D 2250/185; F05D 2260/202
See application file for complete search history.

(56) References Cited

U.S. PATENT DOCUMENTS 5,073,086 A * 12/1991 Cooper ..... F01D 5/187 416/96 R
7,431,562 B2 * 10/2008 Hooper ..... F01D 5/187 416/97 R
8,562,286 B2 * 10/2013 Gleiner ..... F01D 5/187 415/115

(Continued)

FOREIGN PATENT DOCUMENTS

DE 102017110051 11/2017
EP 1 882 820 1/2008

(Continued)

OTHER PUBLICATIONS

Office Action dated Jan. 9, 2020 issued in European Patent Application No. 19181277.5.

*Primary Examiner* — Eldon T Brockman
(74) *Attorney, Agent, or Firm* — Cozen O'Connor

(57) ABSTRACT

A cooling system for cooling a turbine blade with a cooling fluid via an internal flow passage formed in the turbine blade extending from an inlet to an outlet edge having a first passage section defining a first flow direction, a second passage section defining a second flow direction, a wall between the first and second passage section and a diverter, between the first and the second passage section. The wall in a region of the diverter forms a pier head which extends into the region of the first passage section and thereby reduces the flow cross section of the flow passage.

12 Claims, 2 Drawing Sheets

(56) References Cited

U.S. PATENT DOCUMENTS

| | | | | |
|---|---|---|---|---|
| 8,662,825 | B2 * | 3/2014 | Ireland | F01D 5/187<br>415/115 |
| 2005/0281674 | A1 * | 12/2005 | Liang | F01D 5/187<br>416/97 R |
| 2007/0140851 | A1 * | 6/2007 | Hooper | F01D 5/187<br>416/97 R |
| 2011/0058958 | A1 * | 3/2011 | Ireland | F01D 5/187<br>416/97 R |
| 2011/0243717 | A1 * | 10/2011 | Gleiner | F01D 5/187<br>415/177 |
| 2015/0110639 | A1 * | 4/2015 | Herzlinger | F01D 5/18<br>416/96 R |

FOREIGN PATENT DOCUMENTS

| | | | |
|---|---|---|---|
| EP | 2374997 | A2 | 10/2011 |
| EP | 2489838 | A2 | 8/2012 |
| JP | 2004-132218 | | 4/2004 |
| WO | WO 2008/155248 | | 12/2008 |

* cited by examiner

COOLING SYSTEM FOR ACTIVELY COOLING A TURBINE BLADE

BACKGROUND OF THE INVENTION

1. Field of the Invention

The invention relates to a cooling system for actively cooling a turbine blade with a cooling fluid by way of a flow passage formed inside the turbine blade.

2. Description of the Related Art

High temperature turbine blades with internal cooling frequently have the problem of flow separation in regions in which the flow passage or the flow direction of the cooling fluid is diverted. The possible separation of the cooling air flow at the inlet into the next flow passage section diminishes the cooling performance of the fluid and thus also has implications for the lifespan of the turbine blade. Apart from this, flow passages should otherwise be generally designed for an optimum coolant flow pattern.

SUMMARY OF THE INVENTION

An object of one aspect of the present invention provides a turbine blade with internal flow passage formed in the turbine blade, with which the problems are reduced and in particular the potential separation of the cooling air flow is avoided or minimised in regions in which the flow is diverted.

According to one aspect of the invention, a cooling system for actively cooling a turbine blade with a cooling fluid via an internal flow passage formed in the turbine blade is proposed. The flow passage extends from an inlet edge to an outlet edge and comprises a first passage section, which defines a first flow direction, and a second passage section, which defines a second flow direction. Furthermore, the flow passage comprises a wall and a diverter located between the first and second passage section, which is designed to transfer the flow from the first into the second direction. In the region of the diverter, the wall forms a pier head which, at least with a pier head section, extends into the region of the first passage section and thereby reduces the flow cross section of the flow passage in a specific manner as intended. By way of this, the flow of the cooling fluid is accelerated before the diverter. The consequence of this is that the flow can flow into the next flow passage without any or only minor separation by the diverter.

Preferentially, the cooling system is designed so that the flow passage comprises a second diverter at the end of the second passage section, which opens into a third passage section and a second wall between the second and third passage section, which is formed with a second pier head which at least with a pier head section that extends into the region of the second passage section, and because of this likewise specifically reduces the flow cross section of the flow passage in a comparable manner. By way of this, the flow of the cooling fluid is again accelerated before the diverter and the flow at this point can also flow into the next flow passage without any or with only minor separation by the diverter.

In an advantageous embodiment version it is provided that the pier head, viewed in the cross section, is circular arc-shaped, curved or drop-shaped at least in an end-side section and extends in the direction of the first passage section. The extension of the face-end section in the direction of the first passage section brings about the desired cross-sectional constriction and the circular arc-shaped, curved or drop-shaped profile a contour that is optimal for the flow control.

In an alternative exemplary embodiment of the invention it is provided that the pier head, viewed in the cross section, is formed, at least in a face-end section, of a plurality of linear and/or bent polynomial sections and extends in the direction of the first passage section. With suitable arrangement of linear and/or bent polynomial sections, the surface for the flow control can be further optimised.

Favourable, furthermore, is an embodiment in which the outer contour of the first pier head, viewed in the flow direction, extends as follows: commencing from the linearly extending wall of the first passage section with a curvature section, which curves in the direction of the passage section, merging into a part circular arc section of opposite curvature, which in turn merges into the linearly extending wall of the second passage section at the outlet of the diverter, however without the outer contour projecting into the second passage section. By way of this, the flow cross section in the diverter is not changed by the wall at least at the outlet but maintained at this flow edge.

In a further advantageous version it is provided according to the invention that the outer contour of the second pier head viewed in the flow direction extends as follows: commencing from the linearly extending wall of the second passage section with a curvature section, which curves in the direction of the passage section, merging into a part circle-shaped arc section of opposite curvature, which in turn merges into the linearly extending wall of the third passage section at the outlet of the diverter however without the outer contour projecting into the third passage section.

The cooling system according to one aspect of the invention is designed so that the turbine blade comprises an annular space between a lower and upper blade contour, which defines the gas-conducting surface of the turbine blade.

It is advantageous, furthermore, when the center of the pier head is arranged in a region which is arranged offset relative to the annular space within the lower or upper blade contour, in a manner of speaking offset towards the outside opposite the annular space.

In a further development of the present cooling system it is provided, furthermore, that the flow passage comprises an inlet, which forms an opening for receiving the cooling fluid in the flow passage, and a blow-out, which forms an opening for letting the cooling fluid out of the flow passage.

In a preferred embodiment of the invention, the turbine blade comprises a multiplicity of inlet openings in the region of the inlet edge for letting the cooling fluid into the flow passage, which are arranged spaced from one another. Through the multiplicity of the inlet openings, the cooling fluid can be received in the flow passage over the entire width of the turbine blade as a result of which the turbine flow is optimised.

The turbine blade preferentially comprises a multiplicity of outlet openings for letting the cooling fluid out of the flow passage, which are arranged spaced from one another. Through the multiplicity of the inlet openings, the cooling fluid can be let out of the flow passage over the entire width of the turbine blade.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Other advantageous further developments of the invention are characterized in the subclaims and are shown in more detail in the following by way of the figures together with the description of the preferred embodiment of the invention.

It shows.

DETAILED DESCRIPTION OF THE PRESENTLY PREFERRED EMBODIMENTS

In the following, the invention is described by way of an exemplary embodiment making reference to FIG. 1 and FIG. 2.

Figure 1:
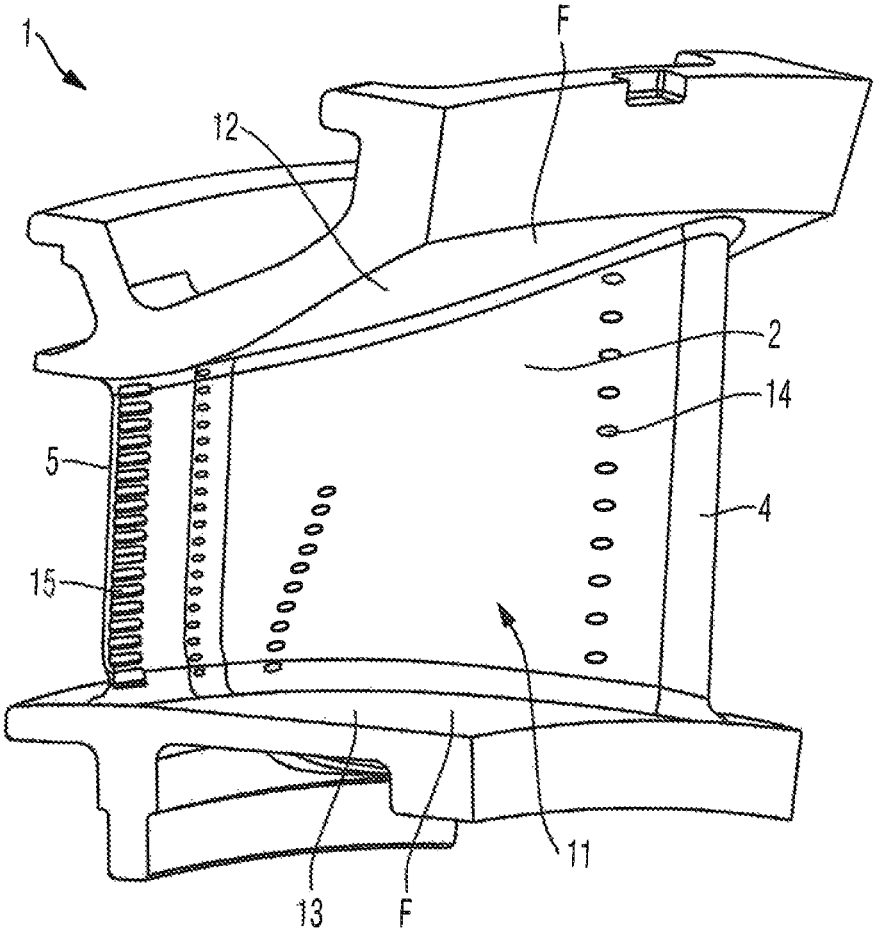
FIG. 1 is a perspective view of a turbine blade with a flow passage located inside.

In FIG. 1, a perspective view of a turbine blade 2 with a flow passage 3 located inside, which is not shown in more detail in FIG. 1, is shown. The turbine blade 2 comprises a rounded inlet edge 4 and an outlet edge 5 and during the course from the inlet edge 4 to the outlet edge 5 is slightly curved. Furthermore, the turbine blade 2 has an upper blade contour 12 and a lower blade contour 13, by which the turbine blade 2 can be mounted in the turbine. The two blade contours 12, 13 each form a surface F substantially extending transversely to the turbine blade 2, which together with the turbine blade 2 forms the gas-conducting annular space 11. Furthermore, FIG. 1 shows multiple outlet openings 14 spaced from one another in the region of the inlet edge 4. Apart from this, multiple outlet openings 15 are formed on the turbine blade 2 which are located on the outlet edge 5.

Figure 2:
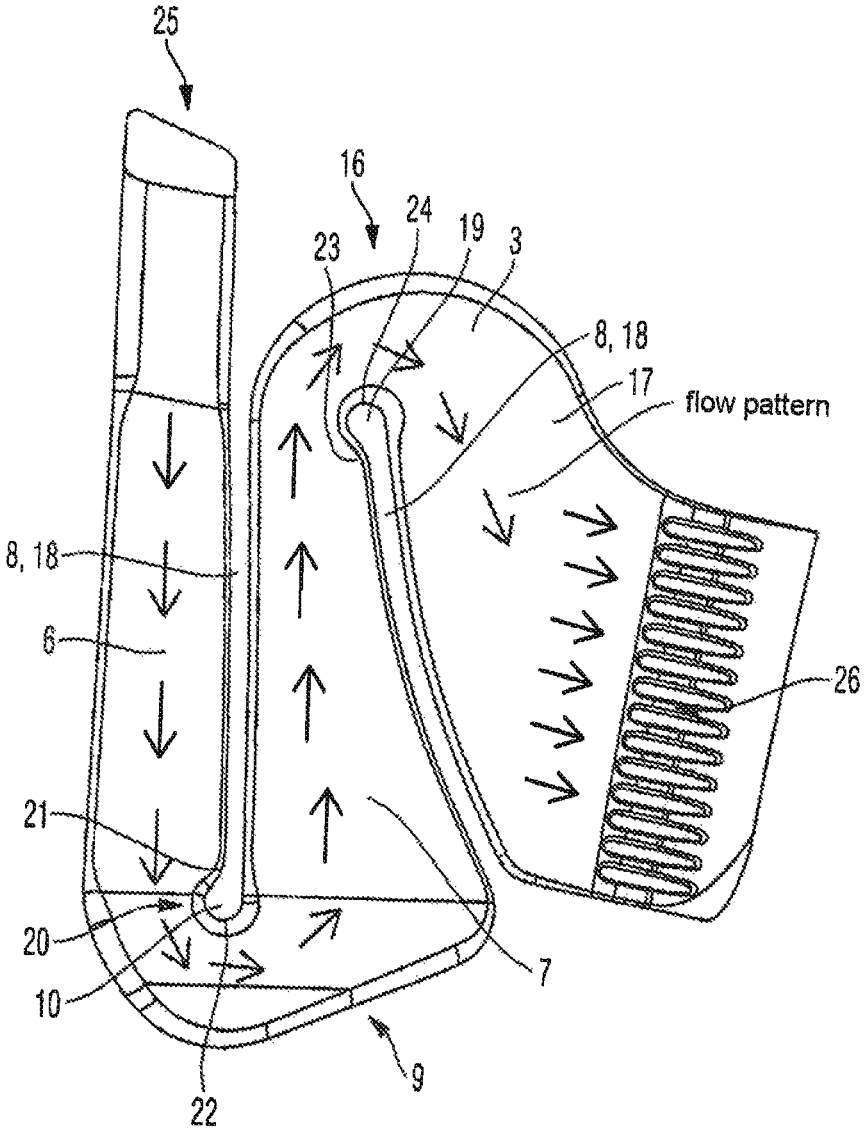
FIG. 2 is a sectional view through a mould for explaining the forming of a flow passage.

FIG. 2 shows a sectional view of a mould, by way of which the flow passage 3 is described. The flow passage 3 is formed with an inlet 25 and an outlet 26. The flow passage comprises a first passage section 6, which is followed by the diverter 9, which initially diverts the flow direction by approximately 90° and then by a further approximately 90° back into the approximately opposite direction in a second passage section 7, which is formed between the diverter 9 and a second diverter 16, and a third passage section 17, which adjoins the diverter 16, which in turn diverts the flow direction by approximately 160° in the approximately opposite direction. Apart from this, FIG. 2 shows the wall 8 and the pier head 10 formed thereon. Commencing from the linearly extending wall 8 of the first passage section 6, the pier head 10 extends with a curvature section 21, which curves in the direction of the passage section 6. The curvature section 21 merges into a part circle-shaped arc section 22 of opposite curvature which in turn merges into the linearly extending wall 8 of the second passage section 7 at the outlet of the diverter 9, however without the outer contour projecting into the second passage section 7.

Furthermore, FIG. 2 shows the wall 18 between the second and third passage section 7, 17 and the pier head 19 formed thereon. Commencing from the linearly extending wall 18 of the second passage section 7, the pier head 19 extends with a curvature section 23, which curves in the direction of the passage section 7. The curvature section 23 merges into a part circle-like arc section 24 of opposite curvature, which in turn merges into the linearly extending wall 18 of the third passage section 17 at the outlet of the diverter 16 however without the outer contour projecting into the third passage section 17.

The arrows in FIG. 2 schematically show the flow pattern in the flow passage 3 produced with the mould.

In this embodiment, the invention is not restricted to the preferred exemplary embodiments stated above. A number of versions is also conceivable which make use of the shown solution even with embodiments of fundamentally different types.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cooling system for actively cooling a turbine blade with a cooling fluid comprising:

the turbine blade having an inlet edge and an outlet edge;

an internal flow passage formed in the turbine blade from an inlet to an outlet, which extends from the inlet edge to the outlet edge and comprises:

a first passage section, which defines a first flow direction;

a second passage section, which defines a second flow direction;

a wall located between the first passage section and the second passage section;

a curved diverter, between the first passage section and the second passage section, which is configured to transfer a fluid flow from the first flow direction into the second flow direction; and a pier head formed by the wall in a region of the diverter, which at least with a pier head section extends into a region of the first passage section that reduces a flow cross section of the internal flow passage, wherein the curved diverter, between the first passage section and the second passage section comprises an arcuate portion opposite the pier head, wherein the second passage narrows in the second flow direction from a widest portion in an area of the pier head.

2. The cooling system according to claim 1, wherein the internal flow passage further comprises:

a third passage section;

a second curved diverter arranged at an end of the second passage section, which opens into the third passage section;

a second wall between the second passage section and third passage section; and a second pier head formed by the second wall, which extends at least with a pier head section into a region of the second passage section that reduces the flow cross section of the internal flow passage wherein the second passage has a narrowest portion in an area of the second pier head.

3. The cooling system according to claim 2, wherein an outer contour of the second pier head viewed in a flow direction extends as follows: commencing from a linearly extending wall of the second passage section with a curvature section, which curves in a direction of the third passage section, merging into a part circle-shaped arc section of opposite curvature, which in turn, at an outlet of the diverter, merges into a linearly extending wall of the third passage section, without the outer contour projecting into the third passage section.

4. The cooling system according to claim 3, wherein the turbine blade comprises an annular space between a lower blade contour and an upper blade contour, which defines a gas-conducting surface of the turbine blade.

5. The cooling system according to claim 4, wherein a center of the pier head is arranged in a region which is arranged offset relative to the annular space within the blade contour lower or the upper blade contour.

6. The cooling system according to claim 2, wherein the second curved diverter is configured to divert the flow direction by substantially 160°.

7. The cooling system according to claim 1, wherein the pier head viewed in cross section is formed at least in a face-end section one of circular arc-shaped, curved, or drop-shaped and extends in a direction of the first passage section.

8. The cooling system according to claim 1, wherein the pier head, viewed in cross section, is formed, at least in a face end section, from a plurality of linear and/or polynomial sections and extends in a direction of the first passage section.

9. The cooling system according to claim 1, wherein an outer contour of the pier head viewed in a flow direction extends as follows: commencing from a linearly extending wall of the first passage section with a curvature section, which curves in a direction of the first passage section, merging into a part circle-shaped arc section of opposite curvature, which in turn, at an outlet of the diverter, merges into a linearly extending wall of the second passage section, without the outer contour projecting into the second passage section.

10. The cooling system according to claim 1, wherein the internal flow passage further comprises:

the inlet, which forms an opening for receiving the cooling fluid in the internal flow passage; and the outlet configured as a blowout, which forms an opening for letting the cooling fluid out of the internal flow passage.

11. The cooling system according to claim 1, wherein the turbine blade, in a region of the inlet edge, comprises a multiplicity of outlet openings configured to let the cooling fluid out of the internal flow passage, which are arranged spaced from one another.

12. The cooling system according to claim 1, wherein the turbine blade comprises a multiplicity of outlet openings configured to let the cooling fluid out of the internal flow passage, which are arranged spaced from one another.

* * * * *